United States Patent [19]

Romanelli

[11] Patent Number: 5,042,443

[45] Date of Patent: Aug. 27, 1991

[54] MULTIPLE-VALVE INTERNAL COMBUSTION ENGINE

[76] Inventor: Francesco Romanelli, 1977 Notre Dome, Quebec, Lachine, Canada, H8S 2G1

[21] Appl. No.: 563,318

[22] Filed: Jul. 27, 1990

[51] Int. Cl.[5] ..... F02B 75/02

[52] U.S. Cl. ..... 123/315; 123/432; 123/90.23

[58] Field of Search ..... 123/90.22, 90.23, 90.27, 123/315, 308, 432

[56] References Cited

U.S. PATENT DOCUMENTS 3,412,552 11/1968 Elsbett ..... 123/188 M

FOREIGN PATENT DOCUMENTS 0151115 11/1980 Japan ..... 123/315
0140518 8/1982 Japan ..... 123/315
0126409 7/1983 Japan ..... 123/432
0025015 2/1984 Japan ..... 123/432
2134977 8/1984 United Kingdom ..... 123/315

*Primary Examiner*—David A. Okonsky

[57] ABSTRACT

A valve placement arrangement for an internal combustion engine including four intake valves and two exhaust valves per cylinder wherein the exhaust valves are disposed across the combustion chamber with ports diametrically opposed externally of the intake valves, spaced as to prevent undue heating and insure minimal thermal loading. The valve placement arrangement provides a double cross flow of intake and exhaust.

9 Claims, 2 Drawing Sheets

MULTIPLE-VALVE INTERNAL COMBUSTION ENGINE

BACKGROUND OF THE INVENTION

This invention relates to a multiple-valve internal combustion engine for a motorized vehicle wherein four intake valves and two exhaust valves are provided for each cylinder.

Engines having multiple-valves are well known in the art. Examples of such engines are disclosed in the following U.S. Patents:

| | |
|---|---|
| 4,363,300 - Honda | 4,471,730 - Honda |
| 4,495,903 - Asano | 4,549,510 - Miyakoshi |
| 4,615,309 - Yoshikawa | 4,617,881 - Aoi et al |
| 4,624,222 - Yoshikawa | 4,637,356 - Kuroda |
| 4,637,357 - Ohmi | 4,638,774 - Aoi |
| 4,660,529 - Yoshikawa | |

From an efficiency standpoint, the engines disclosed in these patents have failed to provide a desirable engine. Multiple valve engines generally require a large surface area for placement as described in the latter patents. However, to accommodate valves as large as possible within the chamber, individual valve seats and specifically the exhaust valve seats are very closely disposed, resulting in high thermal loading. This reduces the efficiency of the engine and thus the advantages of the use of multiple valves is offset by this disadvantage. There is also a practical limit to the types of actuating elements that may be used for the valves and this further determines valve placement.

Accordingly, there remains a need in the industry for a multiple valve motorcycle engine that resists high thermal loading and provides maximum output through the use of more valves.

SUMMARY OF THE INVENTION

The object of this invention is to provide a valve arrangement for an internal combustion engine having a combustion chamber served by four intake valves and two exhaust valves. In accordance with the invention, the porting arrangement includes two exhaust valves being at the furthest point from the center axis of the combustion chamber and four intake valves being lateral to the exhaust valves as to create a double crossflow.

DETAILED DESCRIPTION OF THE PREFERRED EMBODIMENT

Figure 1:
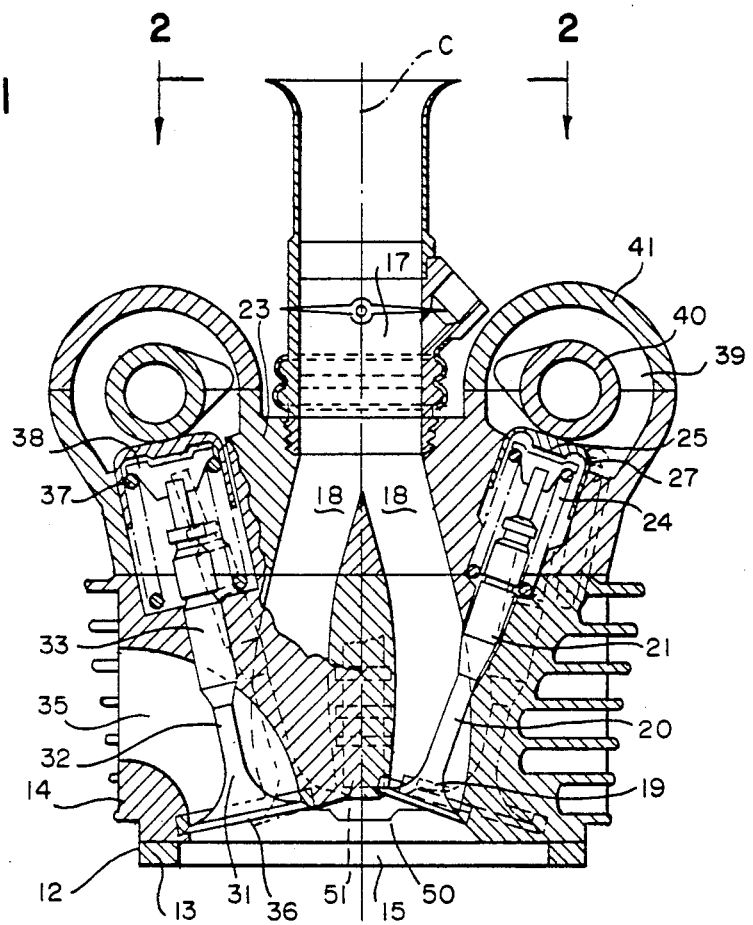
FIG. 1 is a cross sectional view taken through a single cylinder of an internal combustion engine constructed in accordance with this invention and showing only the upper portion of the engine.

With reference to (FIG. 1) numeral (11) indicates an internal combustion engine constructed in accordance with the preferred embodiment of the invention. Because the invention is directed to the porting arrangement and the combustion chamber, only this portion of the engine has been described in detail and only that portion which is associated with a single cylinder will be described in detail. Nevertheless, the present invention may be practiced with multiple cylinder engines of any configuration; the remaining undescribed components of the engine are conventional and clear to those skilled in the art.

The engine includes a cylinder block assembly (12) in which one or more cylinder bores (13) are formed that reciprocally support pistons (not shown) that are connected to drive a crankshaft in a known manner. A cylinder head assembly (14) is affixed to the cylinder block (12) in a known manner and has a number of cavities or recesses (15) that cooperate with the cylinder bores (13) and pistons to provide combustion chambers of varying volume during the reciprocation of the pistons.

An induction system (17) is provided for delivering a charge to the combustion chamber (15). The induction system (17) has two double passages (18) to control flow to the combustion chamber (15). This induction system includes four poppet type intake valves (19) that have stem portions (20) slidably supported in the cylinder head assembly (14) by means of respective valve guides (21) that ar pressed into the cylinder head assembly (14). As illustrated in (FIG. 1 and 2), the intake valves (19), control the flow of intake charge into the chamber (15) from respective intake passages (18) and ports (22*a*, 22*b*, 22*c*, and 22*d*) that are formed in the cylinder head assembly (14) and which open through an outer face (23) of the cylinder head assembly (14).

Encircling each of the valve stems (20) is a coil compression spring (24) having one end in contact with the cylinder head assembly (14) and the other end in contact with a keeper (25) affixed to the valve stem (20) for urging the intake valve to its closed position.

Figure 2:
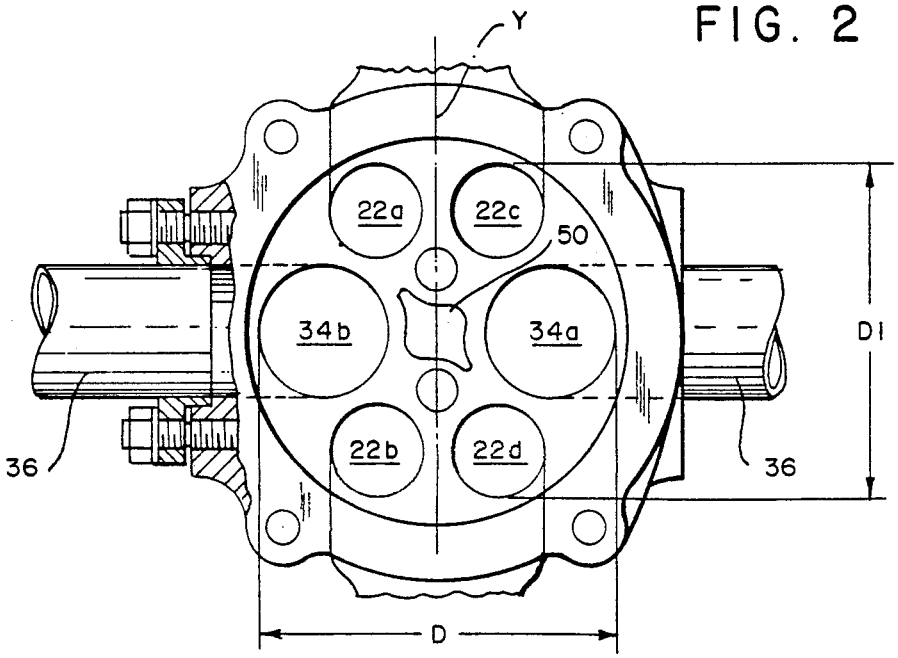
FIG. 2 is a view taken in the direction of line 2—2 in FIG. 1 and shows the valve porting placement and cylinder head combustion chamber configuration.
Figure 3:
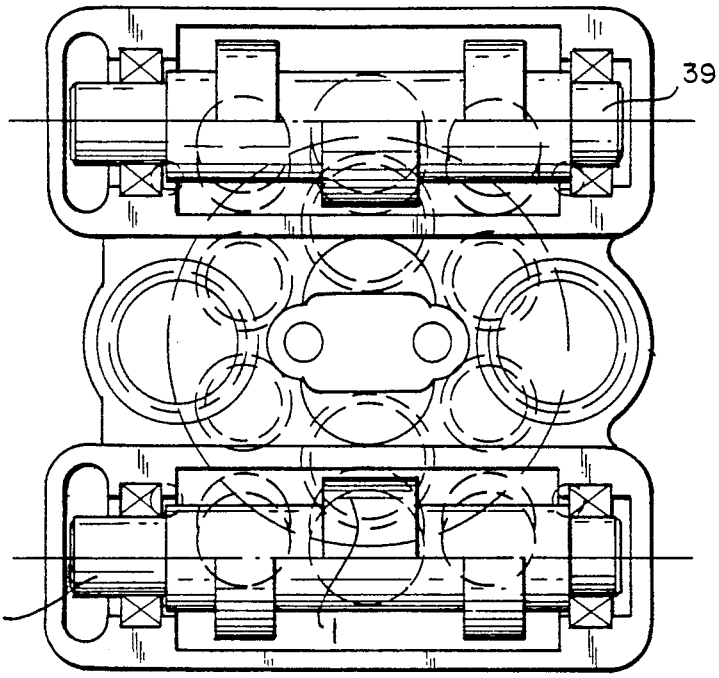
FIG. 3 is a top plan view of the cylinder head assembly with the camshaft cover removed looking in the direction of arrow 2 in FIG. 1.
Figure 4:
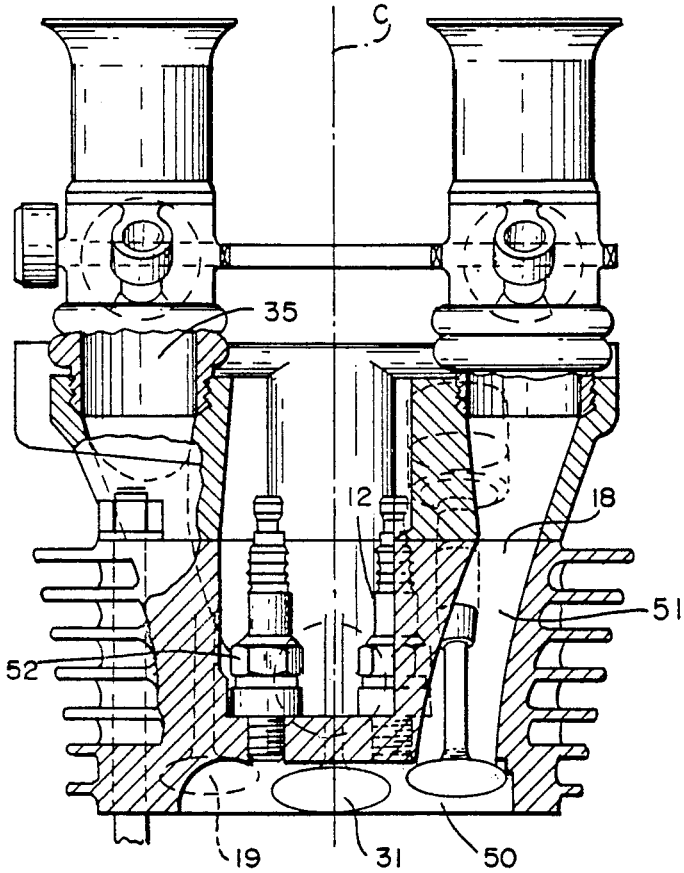
FIG. 4 is a cross sectional view.

Disposed across the cylinder head assembly (14) opposite to the intake passages (18) and the intake valves (19) are two exhaust valves (31*a*, 31*b*) for each combustion chamber (15). The exhaust valves (31) are of the poppet type and have stem portions (32) that are supported for reciprocation within the cylinder head assembly (14) by pressed in valve guides (33). The heads of the exhaust valves control the flow through exhaust ports (34*a*, and 34*b*) that are formed in the cylinder head and lead to exhaust passages (35) located on opposite sides at the periphery of the combustion chamber (3). Each exhaust passage (35) has an individual exhaust pipe (36) as shown in (FIG. 2). The exhaust valve ports (34*a*, 34*b*) are diametrically opposed and widely spaced, so as to prevent undue heating and insure minimal thermal loading. Moreover, the intake valves (19) and the exhaust valves (31) have separate inclination axis of planes at the combustion chamber ending with the same axis of plane at the camshaft. This described positioning of the intake and exhaust valves provides a double crossflow of intake and exhaust. Optimum combustion is further achieved by locating the two exhaust valves as far as possible from the center axis of the combustion chamber and locating the four intake valves laterally of the exhaust valves. The net effect, as illustrated in (FIG. 1–6), is an efficient double crossflow.

Similar in assembly to the intake valves, the exhaust valves have coil valve springs (37) which encircle the upper end of the stems portions (32) of the exhaust valves (31). The springs (37) act against the cylinder head assembly (14) and keepers (38) affixed to the valve stems (32) for urging the exhaust valves to their closed positions.

Two camshaft assemblies (39) are provided, each one operating two intake valves and one exhaust valve. Each camshaft assembly (39) includes a camshaft (40) that is supported by the cylinder assembly (14), for rotation about an axis coinciding with the line is intersected by the stems of the valves. A conventional tappet body (41) is formed in the top of the cylinder head assembly. The camshaft is driven in any suitable manner in timed sequence with the crankshaft of the engine and at one-half engine crankshaft speed.

With the porting arrangement having been described, there is located in the combustion chamber (15) a center or squish area (50). The squish area (50) is actually a volume located between spark plugs (51, 52), the exhaust valves (31), and a built-up area on the piston, when the piston at its uppermost position (TDC). The spark plugs are supported by the cylinder head assembly (14) and positioned on the axis of the cylinder bore for firing in the combustion chamber. This arrangement effectively divides the combustion chamber into two pentpolyspheres and therefore reduces the time required for complete combustion.

In alternative, a modified form of the combustion chamber employs one (1) central spark plug and no squish area.

It should be readily apparent that the described configuration permits a larger valve area and provides a valve placement that increases engine speed. Furthermore, the configuration allows a direct passage to the combustion chamber such that substantially all of the valve, head is visible from the top of the manifold.

The design is subject to modification and variation, all within the design concept. Furthermore, all details can be substituted by technical equivalent.

I claim:

1. A valve arrangement for an internal combustion engine comprising a cylinder head assembly, said cylinder head assembly having a recess defining in part a combustion chamber, four intake valves reciprocally supported by said cylinder head assembly for controlling the flow of intake charge to said combustion chamber, two exhaust valves reciprocally supported by said cylinder head assembly for controlling the flow of exhaust gases from said chamber and, two camshaft assemblies, each said camshaft assembly operable to reciprocate two of said inlet valves and one of said exhaust valves.

2. A valve arrangement for an internal combustion engine as set forth in claim 1 further including an induction system, said induction system having at least two passages leading to respective inlet ports controlled by said intake valves.

3. A valve arrangement for an internal combustion engine as set forth in claim 1 further including a squish area.

4. A valve arrangement for an internal combustion engine comprising:

a cylinder head assembly closing a cylinder, said cylinder head assembly having a recess defining a combustion chamber, four intake valves reciprocally supported by said cylinder head assembly for controlling the flow of intake charge to said combustion chamber, two exhaust valves reciprocally supported by said cylinder head assembly for controlling the flow of exhaust gases from said chamber, and two camshaft assemblies, each of said camshaft assemblies operable to reciprocate two of said inlet valves and one of said exhaust valves, said intake and exhaust valves of each camshaft assembly having separate angles of inclination with respect to a plane including a longitudinal central axis of the cylinder.

5. A valve arrangement for an internal combustion engine is set forth in claim 4 further including an induction system, said induction system having at least two passages leading to respective inlet ports controlled by said intake valves.

6. A valve arrangement for an internal combustion engine as set forth in claim 4 further including a squish area, said squish area defined by the distance between said bores.

7. A valve arrangement for an internal combustion engine, having at least two spark plugs and a piston comprising:

a cylinder head assembly, said cylinder head assembly having a recess that defines in part a combustion chamber, four intake valves reciprocally supported by said cylinder head assembly for controlling the flow of intake charge to said combustion chamber, two exhaust valves reciprocally supported by said cylinder head assembly for controlling the flow of exhaust gases from said chamber, and two camshaft assemblies, each said camshaft assembly operable to reciprocate two of said inlet valves and one of said exhaust valves, said combustion chamber having a squish area, said squish area defined by the space between said spark plugs, said piston and said exhaust valves.

8. A valve arrangement for an internal combustion engine as set forth in claim 7 further including an induction system, said induction system having at least two passages leading to respective inlet ports controlled by said intake valves.

9. A valve arrangement for an internal combustion engine as set forth in claim 8 further including a squish area.

* * * * *